US006431435B1

(12) United States Patent
Jones et al.

(10) Patent No.: US 6,431,435 B1
(45) Date of Patent: Aug. 13, 2002

(54) COLLAPSIBLE BULK MATERIAL CONTAINER

(75) Inventors: Robert J. Jones, Savage; Michael R. Jones, Apple Valley, both of MN (US)

(73) Assignee: RMC Jones LLC, Savage, MN (US)

( * ) Notice: Subject to any disclaimer, the term of this patent is extended or adjusted under 35 U.S.C. 154(b) by 0 days.

(21) Appl. No.: 09/351,389

(22) Filed: Jul. 13, 1999

(51) Int. Cl.[7] ..... B65D 3/00; B65D 5/42

(52) U.S. Cl. ..... 229/117.28; 229/199; 229/122.32; 229/198.2; 229/190; 229/109

(58) Field of Search ..... 229/117.28, 117.27, 229/183, 190, 164.1, 109, 198.2, 122.32, 122.33, 199; 383/119; 141/390

(56) References Cited

U.S. PATENT DOCUMENTS

| | | | | | |
|---|---|---|---|---|---|
| 915,455 | A | * | 3/1909 | Lynch, Jr. | 229/199 X |
| 1,044,023 | A | * | 11/1912 | Colgate | 383/121 X |
| 1,139,281 | A | * | 5/1915 | Hazelton | 383/121 X |
| 1,794,821 | A | * | 3/1931 | Andrews | 229/199 X |
| 2,337,370 | A | * | 12/1943 | Broadfoot | 229/199 X |
| 2,502,586 | A | * | 4/1950 | Ottinger | 383/119 X |
| 2,611,526 | A | * | 9/1952 | George | 229/199 X |
| 3,123,254 | A | * | 3/1964 | Rabby et al. | 229/117.27 X |
| 3,257,068 | A | * | 6/1966 | Wright | 383/119 X |
| 3,423,009 | A | * | 1/1969 | Palmer | 229/199 X |
| 3,653,578 | A | * | 4/1972 | Wood | 229/199 X |
| 3,779,448 | A | * | 12/1973 | Wootten | 229/198.2 X |
| RE28,439 | E | * | 6/1975 | Sherherd | 229/199 X |
| 3,896,991 | A | * | 7/1975 | Kozlowski et al. | 383/121 X |
| 3,937,392 | A | * | 2/1976 | Swisher | 229/199 |
| 3,945,493 | A | | 3/1976 | Cardinal | |
| 3,957,195 | A | * | 5/1976 | Lin | 373/119 X |
| 4,013,168 | A | | 3/1977 | Bamburg et al. | |
| 4,115,909 | A | * | 9/1978 | Corella | 383/119 X |
| 4,176,748 | A | | 12/1979 | Beane | |
| 4,226,327 | A | | 10/1980 | Ballard | |
| 4,308,905 | A | * | 1/1982 | Gallagher | 150/165 X |
| 4,337,888 | A | * | 7/1982 | Kudalkar | 229/198.2 |
| 4,362,199 | A | * | 12/1982 | Futerman | 383/119 X |
| RE31,191 | E | | 3/1983 | Connolly | |
| 4,622,693 | A | * | 11/1986 | Mykleby | 383/119 |
| 4,666,059 | A | * | 5/1987 | Nordstrom | 229/199 X |
| 4,903,431 | A | * | 2/1990 | Stoll | 229/110 |
| 4,997,125 | A | * | 3/1991 | Glerum | 229/199 X |
| 5,158,369 | A | * | 10/1992 | Derby | 383/119 X |
| 5,165,568 | A | * | 11/1992 | Wischusen, III | 383/119 X |
| 5,285,957 | A | * | 2/1994 | Halsell | 229/199 |
| 5,340,217 | A | * | 8/1994 | Rothman | 383/17 |
| 5,405,006 | A | | 4/1995 | Burgdorf et al. | |
| 5,518,168 | A | * | 5/1996 | Mayer | 229/198.2 X |
| 5,566,531 | A | | 10/1996 | Nordstrom et al. | |
| 5,758,973 | A | * | 6/1998 | LaFleur | 383/121 X |
| 5,759,644 | A | * | 6/1998 | Stanley | 150/165 X |
| 5,772,108 | A | * | 6/1998 | Ruggiere, Sr. et al. | 229/199 X |

* cited by examiner

*Primary Examiner*—Lee Young
*Assistant Examiner*—Tri M. Mai
(74) *Attorney, Agent, or Firm*—Merchant & Gould P.C.

(57) ABSTRACT

A container assembly for bulk materials and a method and kit for assembling same are disclosed. A forming member having a plurality of sidewalls defines an internal cavity for receiving bulk materials. The sidewalls are arranged relative to one another and are locked into position so as to define a geometric volume of predetermined shape, by means of a locking assembly. The locking assembly can be integrally attached to or can be separable from the sidewalls, and can form a bottom of the container assembly. A tubular sleeve of continuous material is sized to snugly engage and overlie substantially the entire outer surface area of the sidewalls. The sleeve provides the containment strength, while the forming member provides structural shape and stability to the container assembly.

16 Claims, 9 Drawing Sheets

COLLAPSIBLE BULK MATERIAL CONTAINER

FIELD OF THE INVENTION

This invention relates generally to shipping and storage containers, and more particularly to a container for bulk, liquid and granular materials, which is collapsible and/or reusable or recyclable.

BACKGROUND OF THE INVENTION

Effective, reliable, safe and economical packaging of bulk products for handling, transport and storage has been a concern for many years. Bulk products requiring such packaging vary widely from semi-solids such as meat and other such food items; to granular materials such as beans, peas, grains, rice, salt, flour, sugar, dry chemicals, dry cementitious products, animal feeds, fertilizers, etc.; to liquid materials such as syrups, milk, juices, glues, inks, resins, paints, chemicals, and the like. Since such materials have a tendency to move or flow, containment of them for shipment, handling and storage raises many challenges. It is desirable to package such materials in containers that can be readily transported by truck, rail or ship and which can be easily handled during transport and at a final destination such as at a processing facility by readily available equipment such as fork lifts, cranes and the like. The flowable nature of such products presents unique packaging issues for the container. Movement or shifting of the materials during transport can cause deformation of the container that can result in load shifting and instability and bursting containers, often with enough force to damage or destroy the container. The result is loss or damage to the container contents and undue cleanup and environmental concerns. The containers must even be more stable if stacked on top of each other.

The packaging industry has to date generally used two primary containment approaches: (1) corrugated bulk box containers (both plastic and paper); and (2) large bulk bags of woven fabric generally referred to as flexible intermediate bulk containers (FIBCs). Both approaches use various configurations of liners, typically made of polyethylene or polypropylene, that fit within the corrugated bulk box or within the FIBC for preventing contamination of the product being shipped and, in the case of a liquid product, to contain the liquid. Both packaging approaches use containers typically configured to be supported by and carried on pallets.

Utilizing the corrugated bulk box approach, the container strength needed to handle the wide variety of weight and product consistency requirements is addressed by using different strength grades of corrugated board materials and/or by increasing the wall thickness of the boxes by gluing corrugated sheets together or by inserting a corrugated sleeve into the box. Another approach for strengthening the box container is to wrap a number of plastic or steel straps around the outside periphery of the box. Both techniques suffer shortcomings. The price of the bulk box significantly increases with increased wall thickness and/or numbers of corrugated layers or higher quality corrugated materials. If the box board wall strength and/or thickness is reduced in order to cut costs, and a number of external support straps or bands are used, product pressure against the thinner box walls generally caused the box to bulge outwardly between the straps, resulting in a container having marginal safety factor and leading to numerous costly box failures in shipment.

The FIBCs utilize various fabrics (such as woven polypropylene and PVC coated fabrics) and various fabric weights and sewing methods, depending on the necessary strength of the bag and its desired factor of safety. Such bags vary in size to generally hold from 5 to 120 cubic feet of material and up to about 5,000 pounds of product. They generally can be designed with various shaped tops suitable for filling, can have a solid bottom or a sewn in discharge spout configuration, and may have lifting handles. For dry or fluidized products that require a more rigid bag for stability, solid support inserts may be placed inside the bag, and between the outer bag surface and a liner (if one is used) to provide the bag's sidewalls with more rigidity. Because of the cost of the manufacturing sewing operations and the cost of the rigidity enhancing inserts used in the FIBCs, they typically result in a more expensive container than their corrugated box with strapping counterparts. If used without significant rigidity supports to store liquid materials, the FIBC bag will act like a large water balloon; thereby making the FIBCs more practical for use in shipping and storing dry bulk products. Further, the inserts that are typically placed within the FIBCs to provide sidewall rigidity are joined/hinged at their corners to fold down flat when not in use, and do not have bottoms. Without rigid bottoms, the inserts are susceptible to deformation from their intended footprint configuration during loading of the FIBC, resulting in a misshaped containment system that is unstable before and during shipment. To address this problem, collapsible metal grid cages have been configured to externally support the FIBC, further adding to the cost and use inflexibility of such systems for containing liquids.

The present invention addresses the problems and shortcomings of both the prior corrugated box and the FIBC containment systems. The present invention combines the strength of woven polypropylene materials used in the FIBC technology with unique configurations of inserts using the corrugated box technology, to create a very strong container that is easy to set up, maintains its shape during loading, which is significantly more cost effective, and which is safer and more reliable than heretofore known packaging methods.

SUMMARY OF THE INVENTION

This invention uses existing industry accepted packaging materials to form a unique bulk container system that is universally applicable to the packaging of solid; semi-solid, granular or liquid materials. The bulk container system of this invention combines the advantageous features of known packaging techniques in a unique manner without suffering their respective short comings. An internal forming member or insert of relatively inexpensive light weight corrugated material is used to define an internal geometric volumetric shape of the container in a manner that does not change shape or collapse during loading. The forming member is collapsible for storage and is easily erected by folding to an operable box-like configuration. The forming member insert has a unique bottom design that when assembled, squares-up and locks the forming member sidewalls in predetermined positions to define a desired geometric volume. The forming member is designed to be placed on and carried by a pallet.

An outer tubular sleeve, that can be configured without stitching or seams, is sized to surround and snugly engage the entire outer peripheral sidewall areas of the forming member, and assumes the defined geometric shape of the outer surface of the forming member. The sleeve, preferably of woven polypropylene material, provides the necessary strength for containing the bulk material within the forming member insert, while the insert provides the desired rigidity and shape to the system. Together, they form a stable, multi-purpose and universal container system configuration that is less expensive than either corrugated or FIBC known container configurations. Both the insert and sleeve components of the container system can be collapsed for reuse and are completely recyclable. A standard liner can be inserted within the forming member to protect the contents from contamination or the environment and/or to retain liquids.

The forming member insert can be configured to any desired shape, as dictated by the intended use of the container system. The size of the container and the weight of its contents will dictate the strength of the outer sleeve, which will be of a food grade fabric for food containment applications. The invention also includes forming member configurations that allow relative movement between cooperating portions thereof, such that the insert can expand and contract with the contained contents of the system. Another feature of the invention is a forming member insert design that maintains a given footprint configuration of the container, but which allows the upper portion of the container to reconfigure along predetermined expansion lines to reduce stress across the insert sidewalls.

According to one aspect of the invention, there is provided a container for bulk materials, comprising (a) a forming member comprising a plurality of sidewalls extending between upper and lower edges and interconnected to cooperatively form an outer surface and to encircle an internal cavity for receiving bulk materials, and a locking assembly cooperatively engaging the sidewalls to define and fix predetermined relative positions thereamong; and (b) a sleeve of continuous material sized to snugly engage and to overlie substantially entire outer surface of the sidewalls. According to a further aspect of the invention, the forming member comprises a single piece of material and may be of corrugated construction and collapsible when the locking assembly is not operable to fix the positions of the sidewalls. According to a further aspect of the invention the sleeve comprises a continuous seamless woven material that is tubular and nature and does not have a bottom surface. According to yet a further aspect of the invention, the sleeve is configured to define a fold extending upward from the lower edges of the sidewalls to provide double strength adjacent the lower edges of the sidewalls, and preferably extends upward from the lower edges from about 20% to 50% of the height of the sidewalls. According to yet a further aspect of the invention, the sidewalls are configured for relative sliding engagement with one another to accommodate expansion and contraction of bulk materials contained by the container.

According to yet a further aspect of the invention there is provided a method of configuring a container for bulk materials comprising the steps of: (a) providing a forming member of the type having a plurality of sidewalls extending between first and second edges; (b) arranging said sidewalls in a closed manner such that they collectively define an internal cavity longitudinally extending between the planes defined by the first and second edges; (c) providing a locking assembly; (d) engaging the locking assembly with the sidewalls to fix the geometric shape of the internal cavity defined thereby; (e) providing a circumferentially continuous length of tubular sleeve material; and (f) snugly engaging the tubular sleeve around the outer periphery of the sidewalls such that the sleeve engages substantially the entire outer surface area of the sidewalls.

According to yet a further aspect of the invention there is provided a kit for a bulk material container, comprising: (a) a forming member comprising a plurality of sidewalls extending between upper and lower edges and configured for interconnection to cooperatively form an outer surface and to encircle an internal cavity for receiving bulk materials, and a locking assembly configured to cooperatively engage the sidewalls to define and fix predetermined relative positions thereamong; and (b) a sleeve of continuous material sized to snugly engage and to overly substantially the entire outer surface of said sidewalls.

These and other features of the invention will become apparent upon a more detailed description of preferred embodiment of the invention as described below.

BRIEF DESCRIPTION OF THE DRAWING

Referring to the Drawing, wherein like numerals represent like parts throughout the several views.

DETAILED DESCRIPTION OF THE PREFERRED EMBODIMENT

Figure 1:
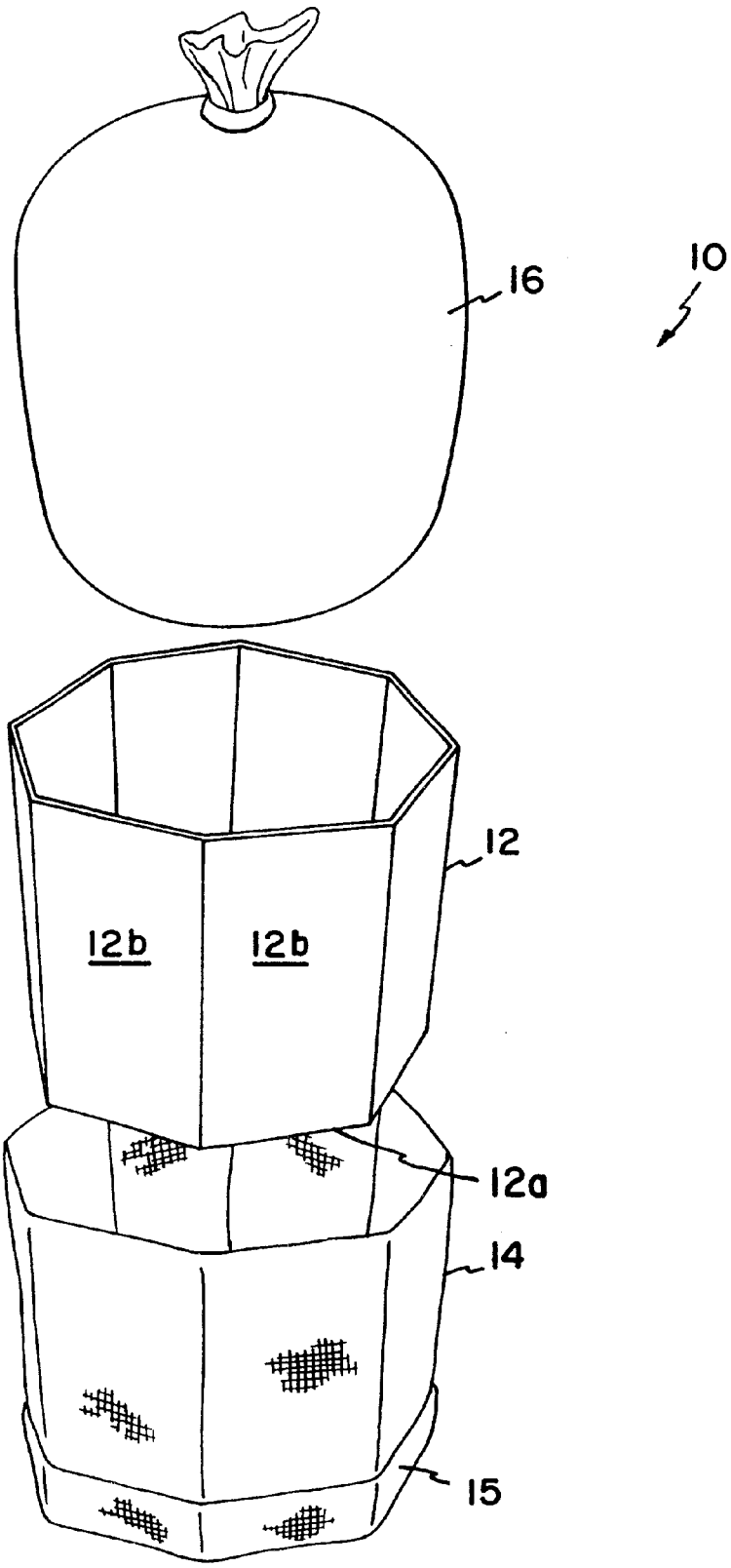
FIG. 1 is an exploded perspective view of a bulk material container assembly configured according to the principles of this invention.
Figure 2:
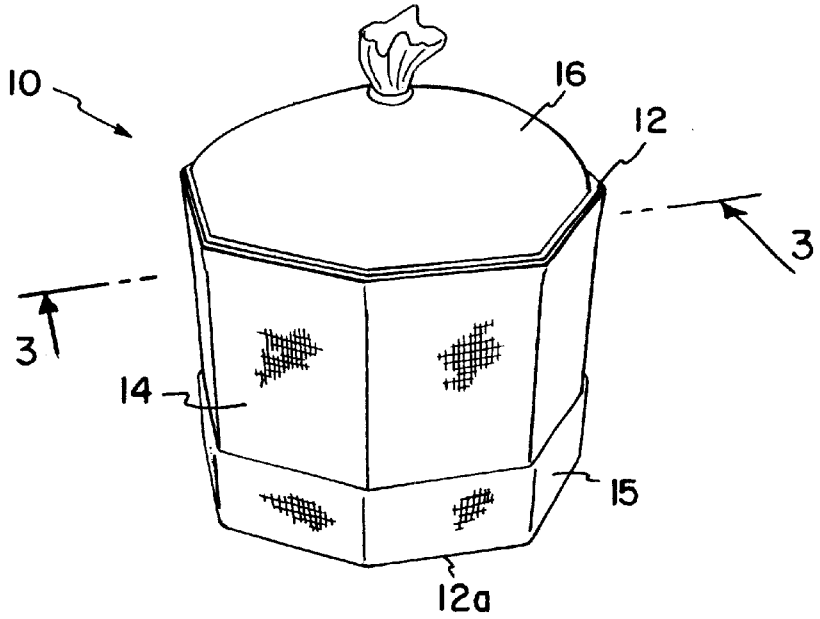
FIG. 2 is a perspective view of the container assembly of FIG. 1, illustrated as it would appear assembled.
Figure 3:
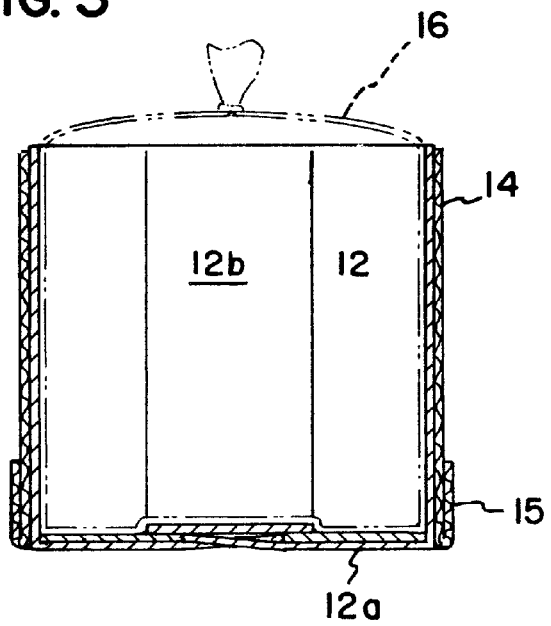
FIG. 3 is a sectional view generally taken along the Line 3—3 of FIG. 2.

A preferred embodiment of a container system incorporating the principles of this invention is generally illustrated at 10 in FIGS. 1 and 2. The two basic components of the container system are a forming member insert, generally indicated at 12 and an outer support sleeve member 14. The forming member insert provides defined geometric shape and structure to the container system while the sleeve member is sized to cooperatively and snugly engage and circumferentially surround substantially the entire sidewall portions of the forming member insert 12, as hereinafter discussed in more detail. An optional liner, well-known in the art generally indicated at 16 can be inserted within the forming member insert 12, to protect the container contents from contamination and/or to retain liquid contents.

The forming member insert 12 is preferably configured of a relatively light weight corrugated material which can be either of cellulose or plastic construction. When collapsed, the forming member 12 can be configured as a single planar sheet, or, depending upon the particular construction, folded over on itself in a collapsed manner. When erected in operative manner, the forming member includes a bottom construction that provides a predetermined two-dimensional geometric configuration to the bottom of the forming member. The sidewalls 12*b* of the forming member extend upwardly and generally perpendicular to the plane of the bottom 12*a* and collectively define with the bottom an internal geometric volume that represents the storage portion of the container system. The forming member insert 12 is configured to lie upon and be carried by a pallet of a type well-known in the shipping industry. Depending upon the size of the forming member, one or more of such forming members may lie on the same pallet. The thickness and strength of the corrugated material of the forming member 12 is a matter of engineering design and will vary depending on the shape and size of the container and upon the type and weight of the materials to be contained thereby. However, the thickness and strength thereof can be significantly reduced as compared to standard corrugated containers, since the wall portions of the forming member do not have to provide the containment strength of the container system. Their function is to simply provide structural shape to the outer wall areas of the container, so as to provide a measure of rigidity and stability to the container system. The height, size, shape and dimensions of the forming member can also vary, as desired or dictated by the use to which the container system will be put. When used to replace FIBC containers, the forming member could be sized to accommodate a typical pallet grid unit which would enable shippers and users of the container system to handle the system with existing in-plant equipment such as fork lifts, overhead cranes or jib cranes. As with prior containers, the container system of this invention can be tailored in size and shape to fit each customer's needs. For example, the container systems could be configured to accommodate packaging needs as small as five cubic feet for handling high bulk density weight products or could be configured to handle much large sizes up to, for example, 120 cubic feet.

While a preferred construction of the forming member is one in which the entire forming member is configured from a single planar sheet or blank of corrugated material, the invention does not require a one-piece construction. For example, the sidewall 12*b* portions of the forming member could be formed from a single sheet of material; whereas the bottom 12*a* could be formed from a second, separable piece of material. The important aspect of the forming member 12 is that it contain a bottom or similar structure that gives predetermined fixed geometric definition to the sidewall portions of the forming member, and particularly to the lower base portions thereof. Further, while the preferred embodiment will be described with respect to forming member inserts that are constructed from the same corrugated material, the invention does not require the same material to be used for both the sidewall 12*b* and bottom or shape defining portions 12*a* of the forming member.

The outer containment sleeve 14 is preferably constructed of the same types of materials, well-known in the art, that are used for making flexible intermediate bulk containers (FIBCs). The sleeve is preferably configured from a flexible woven fiber material, preferably woven polypropylene or polyethylene materials which are known for their strength and light weight. Such fabrics come in various weights, which would be selected in accordance with the necessary strength and safety factors required by the container. As with fabrics used in the FIBC industry, the sleeve material could be coated or remain breathable, could be treated for ultra violet retardation, could be configured for weather resistance, or could, for example, be of a fabric that complies with the Food and Drug Administration criteria for foods, pharmaceuticals and edibles, and the like. Those skilled in the art will readily recognize these and other options for appropriate materials that could be used for the containment sleeve. The sleeve provides the containment strength of the container system, and must be of a strength suitable for supporting the forces applied by the contained material against the inner surfaces of the forming member sidewalls 12*b*. The sleeve is preferably of tubular and seamless construction, requiring no sewing or stitching. For assembly purposes, the sleeve material could simply be cut to a desired length by a hot knife technique. The sleeve 14 extends from the lower edges of the sidewalls 12*b* of the forming member to their upper edges and is sized to snugly engage and cover virtually the entire outer peripheral surface area of sidewalls. Since the sleeve does not have a bottom as is the case with an FIBC, significant manufacturing costs are saved as compared to the FIBC manufacturing process, by eliminating all stitching and sewing operations. As illustrated in FIGS. 1 and 2, the length or height of the sleeve 14 is cut longer than the vertical height of the sidewall portions of the forming member insert 12, such that the lower portion of the sleeve 14 can be folded back upon itself (as illustrated at 15) and extends upwards along the lower portions of the sidewalls to provide additional strength along the bottom surface area portions of the sidewalls, where the pressure caused by weight of the contained material is the greatest. The folded over sleeve portion 15 preferably extends from about 20% to 50% of the height of the sidewalls 12*b*, and more preferably from about 20% to 30% of the height of the sidewalls.

The optional liner 16 may be of any appropriate film or sheet of flexible impervious material, preferably polyethylene or polypropylene, to protect the contents of the container system and/or to prevent leakage of liquids or sifting of powders out of the forming member insert. Such liners are well-known in the art and have been used in the past for both corrugated and FIBC packaging. The liner could be of a type strong enough to lift the entire contents from the forming member insert for unloading purposes and could include a filling spout and sealing mechanism, as well as a discharged spout. The liner could also be made just thin enough to provide an impervious inner coating or layer to the forming member insert 12. Often, wherein the contents of the shipping container are pumped out of the container during removal, the liner need only be strong enough to allow lifting of any residual product left in the liner following the pumping operation, in order to remove and reclaim the residual materials. As with the forming member insert, both the sleeve and the liner are flexible and collapsible so that they can be reused and/or recycled, making the entire container system a collapsible and recyclable system.

The cellulose corrugated material used in a preferred embodiment of the invention for the forming member insert 12 may be obtained from any corrugated material supplier such as from Menasha Corp. of Lakeville, Minn. or from the Packaging Corporation of America. Plastic corrugated materials could also be obtained from any number of different suppliers such as Menasha Corp. or Liberty Carton of St. Louis Park, Minn. As mentioned above, the weight and strength of the corrugated material depends on the application to which the container system will be put, and the method of use of the container. In general, this invention allows use of a relatively inexpensive material, since the primary containment strength of the container system will not depend on the strength of the forming member insert material, but rather on the strength of the outer sleeve 14. For example, for smaller containers a single weight 175 lb. C flute material might be adequate; whereas for even larger containers that might hold up to 2,000 pounds of material, a relatively low weight corrugation in the 200 lb. to 275 lb. C flute material range may suffice. In contrast, for the same application, a prior art total cardboard corrugation construction may require several layers of double wall 400 lb. to 500 lb. weight materials to achieve the same purpose. Often, the prior art corrugated materials also would require the insertion of filament tape between the flutes to provide additional support and/or cross fluted configurations and gluing of the respective corrugated layers to one another to form a strengthened laminated configuration.

The woven tubular material forming the outer sleeve 14 can be readily purchased from any supplier of FIBCs such as from B.A.G. Corp. of Dallas, Tex. or from other distributors or suppliers such as Tech Packaging Group of Joplin, Mo. or National Paperboard Group, Inc. of Burnsville, Minn. The woven polypropylene tubular sleeve material is typically graded by weight. A preferred weight of material that is acceptable for most applications is a 5.2 oz. weight. The liner bags 16 can be purchased generally from the same suppliers that supply the FIBCs.

Lighter weight materials can be used for the outer sleeve of this invention as compared with FIBC applications, since the sleeve only needs to support horizontally applied containment forces. It should be noted that the maximum bulk material handling weight specifications for materials used in constructing FIBCs do not generally apply to this invention, since the weakest feature of FIBC construction relates to the stitching used in the FIBC bag construction. Generally, the stitching of a FIBC will fail long before the woven fabric. Since there is no stitching required for the sleeve of the present invention, this invention takes full advantage of the base strength of the woven material, enabling the use of relatively lighter weight materials for containing relatively heavy parcels of contained materials. Further, due to its woven construction, small holes or the like that may be imparted to the sleeve fabric during use will generally not result in catastrophic failure or unraveling or rupture of the sleeve that would reduce its containment strength as used in this invention.

Figure 4A:
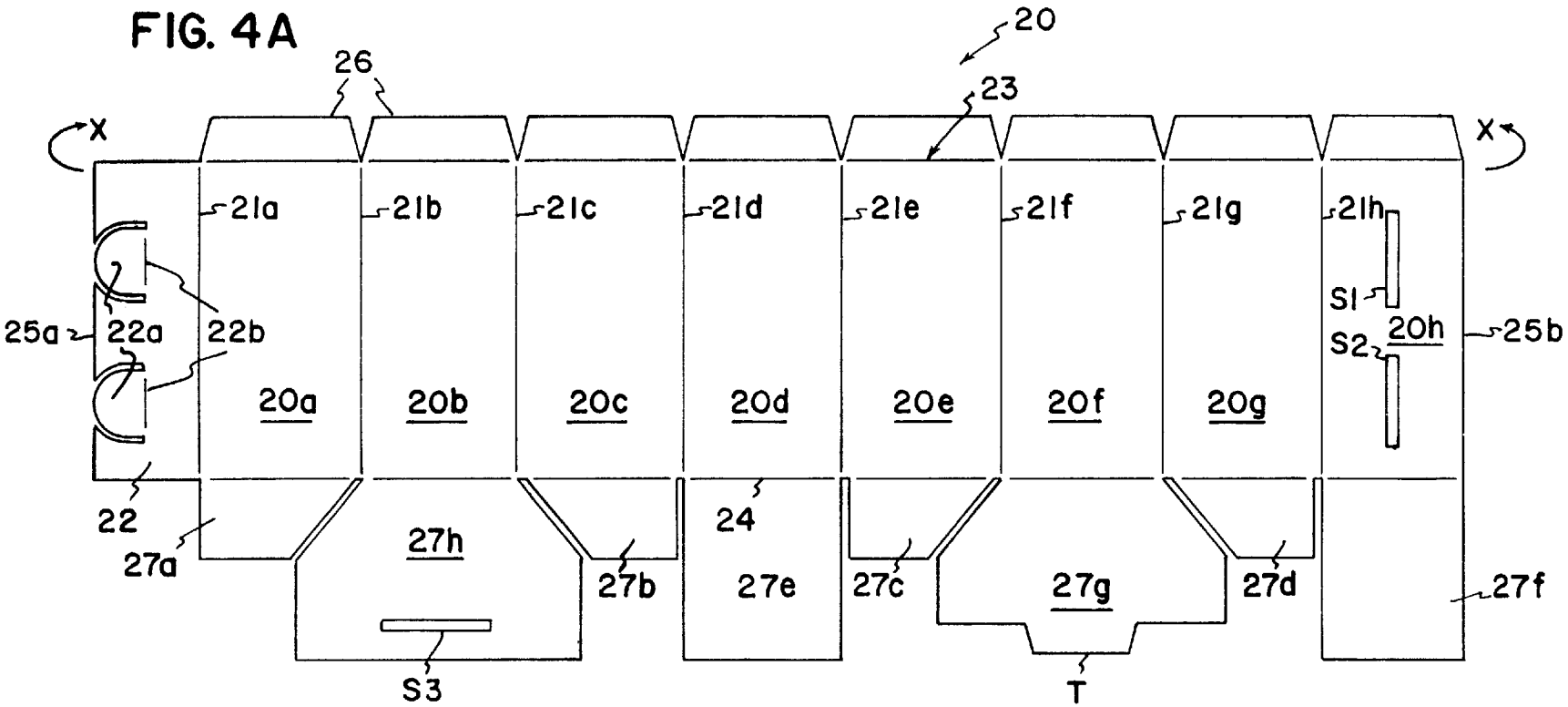
FIG. 4A is a view illustrating on a planar sheet the cut and fold pattern of a first embodiment of a corrugated forming member portion of the container assembly of FIG. 1.

A first embodiment of the forming member insert, constructed from corrugated cellulose (cardboard) material, is illustrated at 20 in FIGS. 4A–4D. In the preferred embodiment, the forming member 20 is configured from a single piece of corrugated material that is scored and patterned for folding, as illustrated in FIG. 4A. Referring thereto, the forming member 20 has eight sidewall portions 20*a*–20*h* consecutively connected and defined by intervening fold lines 21*a*–21*h* respectively, which eventually define the eight "corners" of the forming member. A connecting wall member 22 is contiguous with sidewall 20*a* and extends outwardly from fold line 21*a*. Connector wall 22 has a pair of arcuate tabs 22*a* cut into the wall and projecting back from the side edge 25*a* back to fold lines 22*b*. The insert 20 also has an upper edge 23, a lower edge fold line 24 and oppositely disposed side edges 25*a* and 25*b*. Each of the sidewalls 20*a*–20*h* has a tab 26 projecting upwardly therefrom that folds along the upper edge 23 of the forming member. The ends of the tabs 26 are cut at a taper from the respective fold lines 21*a*–21 *h* and the end 25*b* so as to minimize interference with one another when folded in toward the center of the structure.

The insert 20 also has a plurality of downwardly depending tab portions 27*a*–27*h* which collectively define the bottom 28 of the forming member 20, as hereinafter described. End wall 20*h* includes a pair of vertically aligned slots S1 and S2 for cooperatively receiving the arcuate tabs 22*a* of the connector wall 22. Bottom tab 27*g* also has an extended key member, generally designated at T. Bottom tab 27*h* has a horizontal slot S3 cooperatively sized for accepting the extended key member T of bottom tab 27*g*.

Figure 4D:
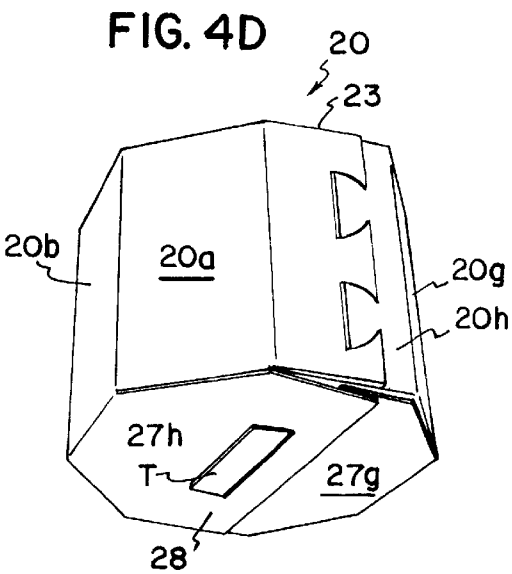
FIGS. 4B–4D illustrate bottom perspective views of the corrugated forming member of FIG. 4A, showing progressive stages of folding of its various segments to derive an operative closed bottom configuration of the first embodiment forming member.
Figure 4C:
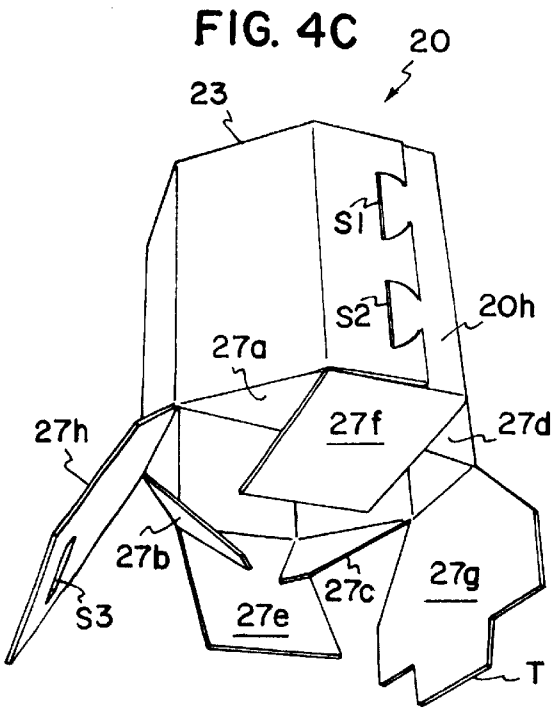
Figure 4B:
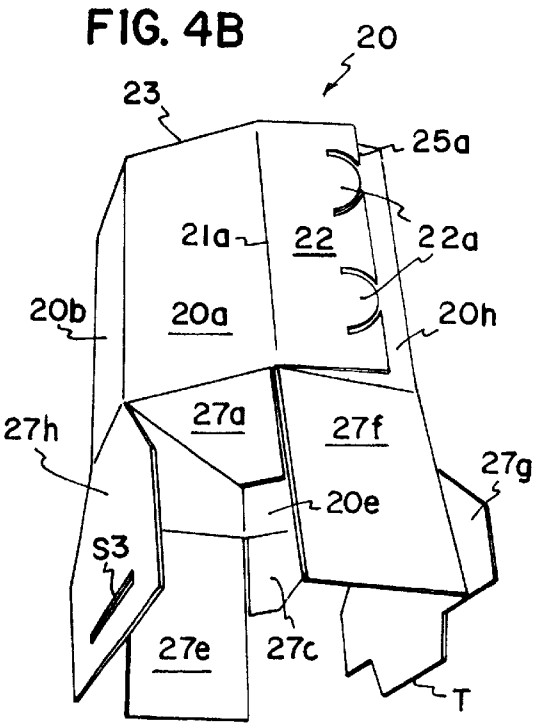

The forming member patterned blank material of FIG. 4A is progressively folded as illustrated in FIGS. 4B–4D, until a box-like hexagonal receptacle is configured, with bottom 28 is defined, as illustrated in FIG. 4D. To form the box-like receptacle configuration, the material illustrated in the FIG. 4A pattern is folded along the wall fold lines 21 so that the side edges 25*a* and 25*b* move toward one another (illustrated by "X"), and until the side edge 25*a* engages the slots S1 and S2 of sidewall 20*h* such that the arcuate tab members 22*a* are slideably received within the slots S1 and S2. The upper tabs 26 are folded inward, along the upper edge 23. In this position, the connecting wall 22 overlies the end sidewall 20*h* and is connected thereto by means of the tabs 22*a* and slots S1 and S2 combination. At this stage, the forming member 20 would appear as illustrated in FIG. 4B. At this point, the structure is still foldable upon itself and can be folded into a collapsed position, since the bottom 28 has not yet been formed.

The bottom 28 of the forming member 20 is defined by folding in the lower tab extensions 27, toward the center of the enclosed cavity defined by the connected sidewalls 20. The angled tabs 27*a*, 27*b*, 27*c* and 27*d* are folded in first, followed by tabs 27*e* and 27*f*, and finally by tabs 27*g* and 27*h*. The distal key end (T) of bottom tab 27*g* is received by and retained within the slot S3 of tab 27*h*, in interlocking manner, to complete and hold the bottom assembly 28 in place, as illustrated in FIG. 4D. Such bottom configuration 28 not only defines but locks in the positions of the sidewalls. The inner sidewalls and bottom portions of the assembled forming member 20 collectively define an internal geometric solid shaped cavity as established and maintained by the outer peripheral edge shape or "footprint" of the plane of the bottom 28. According to a preferred configuration of the FIG. 4 structure, each of the sidewalls is 17.875 inches wide, providing a diameter footprint of 43×43 inches and a circumference of 143 inches. According to the preferred embodiment, the height of the container from the bottom edge 24 to the upper edge 23 is 44 inches.

It will be noted that the tab members 22*a* are slideable within the slots S1 and S2. Such sliding construction provides for limited relative movement of the sidewall configuration to accommodate expansion and contraction of the material being contained by the container assembly. Such movement prevents rupturing of the forming member within the outer sleeve that might otherwise occur if the forming member ends were glued together. Also, such expansion feature accommodates any tolerance differences between the circumferences of the outer surface of the forming member and the inner surface of the tubular sleeve.

Figure 5A:
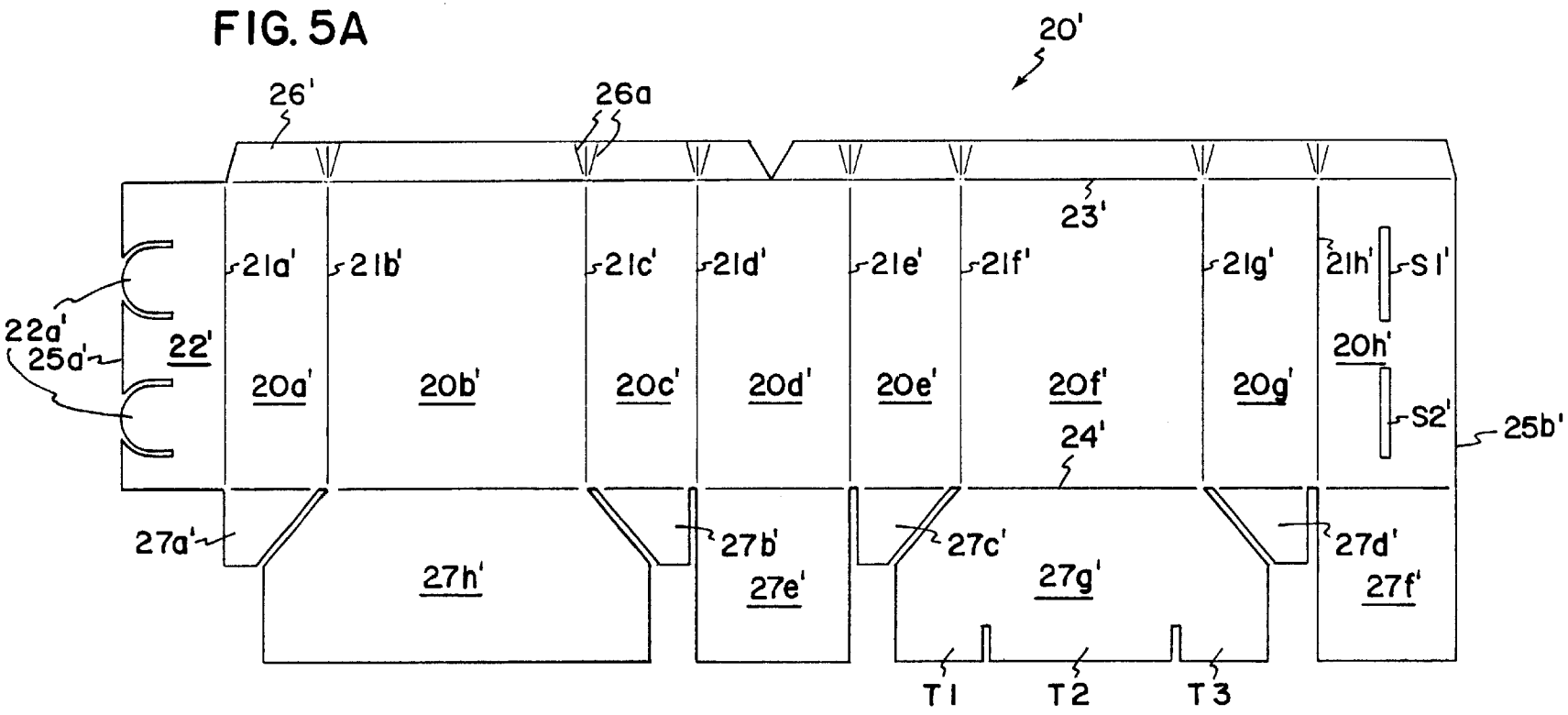
FIG. 5A is a view illustrating on a planar sheet the cut and fold patterns of a second embodiment of a corrugated forming member portion of the container assembly of FIG. 1.
Figure 5D:
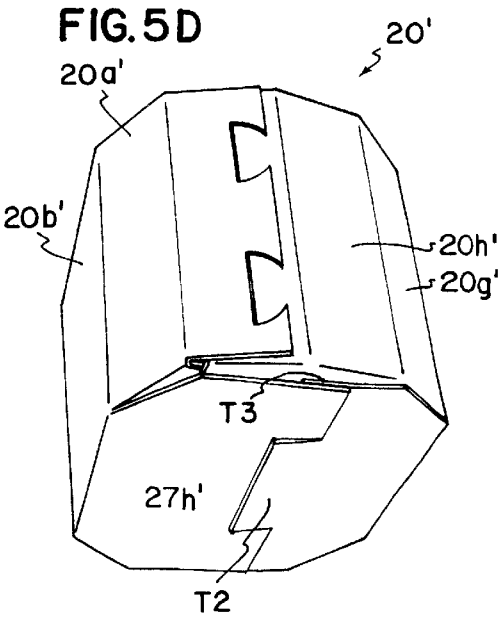
FIGS. 5B–5D illustrate bottom perspective views of the corrugated forming member of FIG. 5A showing progressive stages of folding of its various segments to derive an operative closed bottom configuration of the second embodiment forming member.
Figure 5C:
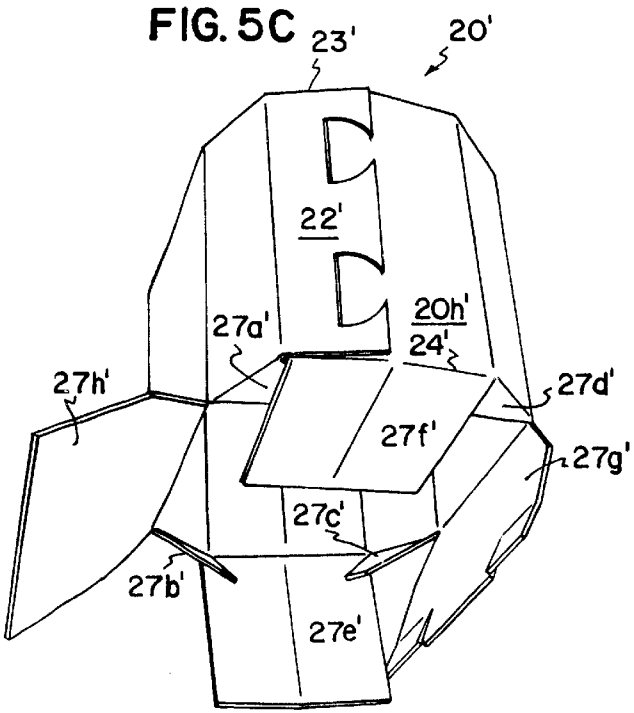
Figure 5B:
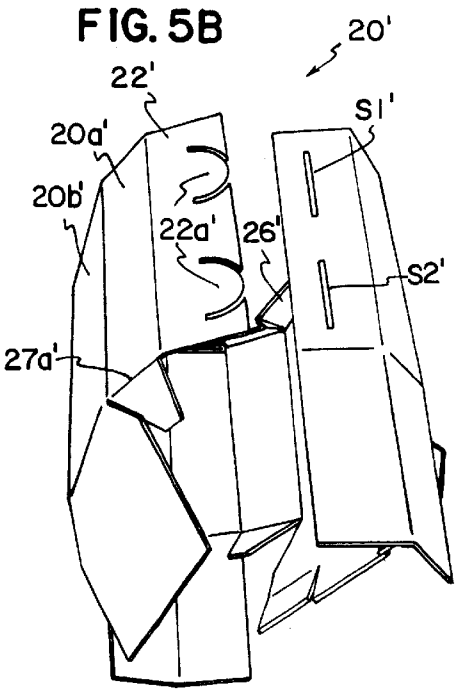

A second hexagonal embodiment of a forming member 20' is illustrated in FIGS. 5A–5D. The general function and folding pattern of the corrugated sheet defining the forming member 20' is basically the same as that of the forming member 20 with the following changes: (1) the uniform width dimension of the sidewalls has been changed to an irregular width pattern; (2) the upper individual tabs 26 of the forming member 20 have been replaced by a pair of elongate tabs 26' having fold score marks 26*a* replacing the notched cuts of the forming member 20 pattern; and (3) the slot S3 of bottom tab 27*h* has been deleted in bottom tab 27*h'* of the second forming member, and the lower edge of bottom 27*g'* has been reconfigured to include three tabs T1, T2 and T3, separated by a pair of notches. When assembled as illustrated in FIG. 5D, the second embodiment forming member 20' provides a more elongated hexagonal structure than the regular rectangular structure of the FIG. 4 forming member.

A third embodiment of a forming member is illustrated generally at 30 in FIGS. 6A–6E. Referring thereto, the third embodiment of the forming member is a four sided container when assembled, with its four primary sidewalls represented by the panels 31*a*–31*d*. The corners of the sidewalls 31*a*–3*d* are defined by the vertical fold lines 32*a*–32*d*. The forming member includes a connector wall extension 33 having an upper arcuate connecting tab 33*a* and a lower connecting tab 33*b*, both terminating at a first edge 34*a* of the forming member. The opposite vertical edge of the forming member 34*b* defines one edge of the sidewall 31*d*. The upper edge of the forming member is designated at 35, and the lower edge of the sidewalls is defined by the first horizontal fold line 36. The forming member includes two additional horizontal fold lines 37 and 38 extending the full width of the pattern. The vertical distance between the fold lines 36 and 37 is the same as that between fold lines 37 and 38. A first horizontal panel 39 is defined and extends the entire width of the pattern between the horizontal fold lines 36 and 37. A second horizontal panel 40 is defined and extends the entire width of the pattern between the horizontal fold lines 37 and 38. The panel 40 includes a cantilevered extension or tab 40*a* (illustrated at the left side of FIG. 6A.) The forming member 30 further includes four downwardly extending bottom panel members 41*a*–41*d* respectively located below the sidewall panel portions 31*a*–31*d*. A plurality of horizontal cuts, generally designated at C1–C5 are formed approximately one fourth of the way up the sidewall panels and intersecting the vertical fold lines 32*a*–32*d* and extending through the oppositely disposed edges 34*a* and 34*b*.

This embodiment of the forming member includes a stress relief feature associated with each of the corners 32*a*–32*d* of the forming member. As the container assembly is filled, causing pressure to be applied to the sidewalls 31*a*–3*d* of the forming member, there is a natural tendency for the upper portion of the forming member to deform to a circular cross-sectional configuration. Such deformation tendency places stress on the forming member sidewalls that is greater in a rectangular container configuration where the corners between sidewalls are at 90° angles. In order to relieve such stress, and to allow for controlled sidewall deformation, the sidewalls are vertically scored adjacent and on either side of the corners 32*a*–32*d*, as indicated by the dashed score lines 50*a*–50*d* in FIG. 6A. Each of the score line pairs vertically extends on either side of a respective corner, in parallel manner, from the upper edge 35 and downwardly to the edges of the cuts C1–C5. It will be noted that the score line pair 50*a* is partially on sidewall 31*a* and partially on 31*d*, since these two sidewalls will be contiguous to one another in the assembled structure. Each pair of the stress relief score lines converge toward one another, in V-shaped manner, slightly below the cuts C1–C5 and meet at the fold line 36 that will represent the bottom of the respective sidewalls. As illustrated in more detail in FIG. 6E, the cuts C1–C5 allow the portions of the sidewalls above the cuts to outwardly deform to a greater extent than that portion of the sidewalls located below the cuts, without placing undue stress to the lower corners of the forming member. FIG. 6E has been illustrated with respect to corner 32*b* and is a view taken from the inside of the forming member corner. The resultant deformation of the forming member 30 allowed during loading of the container, effectively changes the cross-sectional shape of the forming member from a rectangular configuration to a nearly circular twelve-sided configuration.

Figure 6A:
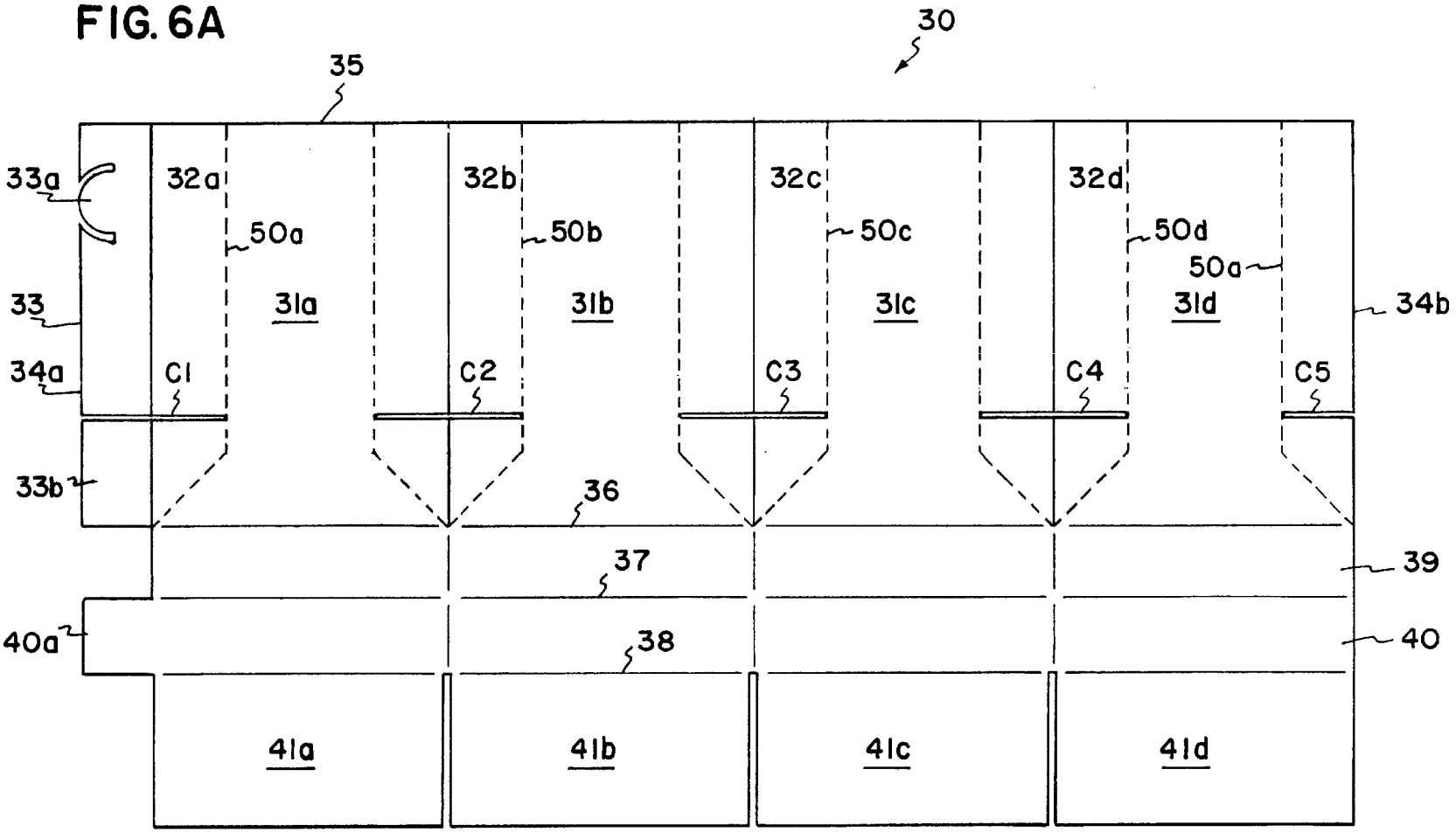
FIG. 6A is a view illustrating on a planar sheet the cut and fold pattern of a third embodiment of a corrugating forming member portion of the container assembly of FIG. 1.
Figure 6D:
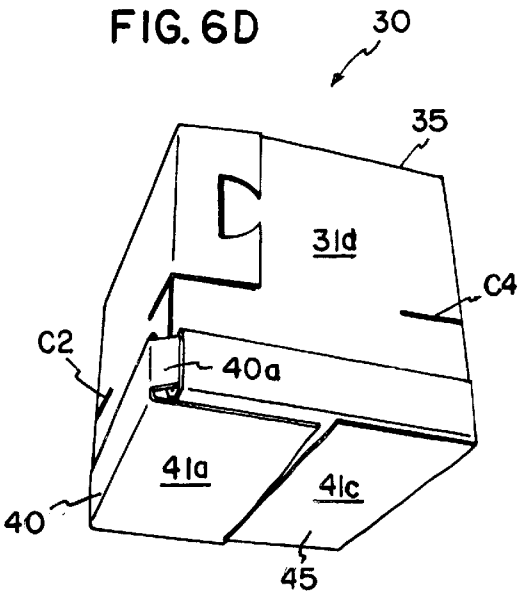
FIGS. 6B–6D illustrate bottom perspective views of the corrugating forming member of FIG. 6A showing progressive stages of folding of its various segments, to derive an operative closed bottom configuration of the third embodiment forming member.
Figure 6C:
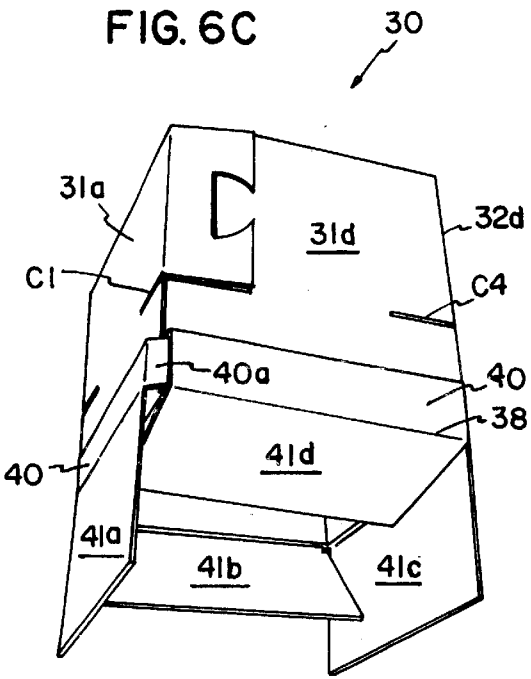
Figure 6B:
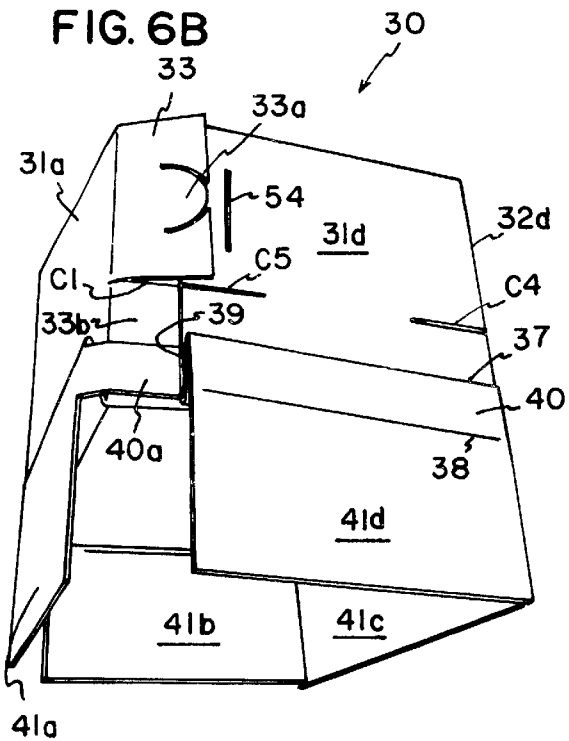
Figure 6E:
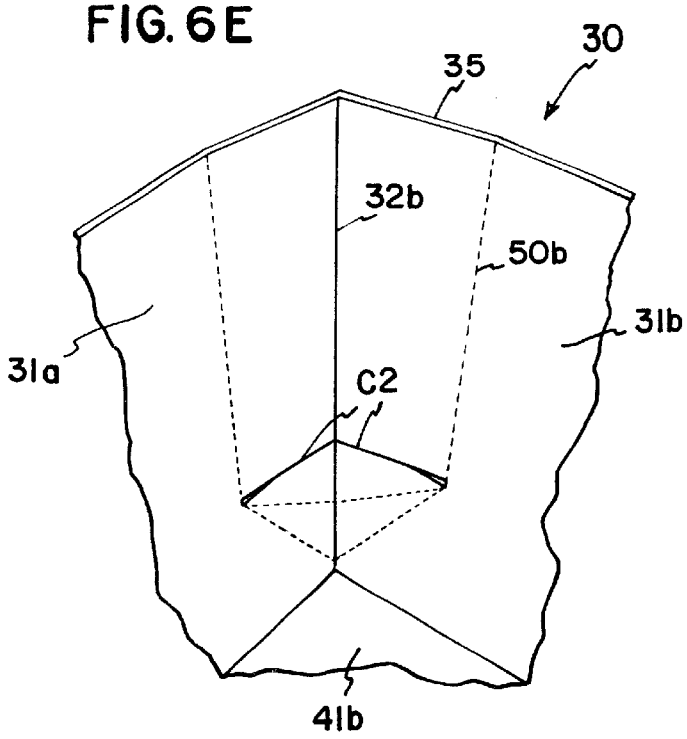
FIG. 6E is a partial top perspective view of an inside upper corner of the third embodiment of the corrugating forming member of FIGS. 6A–6D, illustrating how the corner changes shape along the upper predetermined score lines as pressure is applied to the inner sidewalls of the forming member.

The forming member patterned blank material of FIG. 6A is progressively folded as illustrated in FIGS. 6B–6D, until a box-like rectangular receptacle is configured with bottom 45 as defined, as illustrated in 6D. To form the box-like receptacle configuration, the pattern material illustrated in FIG. 6A is first folded along the fold line 36 such that the horizontal panel 39 and 40 and the lower bottom panels 41 are folded outwardly at an angle of 180° about the fold line 36 and lie in engagement with the sidewall members 31. Next, the pattern is folded along the horizontal fold line 37, such that the bottom tab panels 41 are again disposed in a downwardly depending position and the "inner" surfaces of horizontal panel portions 39 and 40 cooperatively engage one another. The horizontal panels 39 and 40 define a circumferentially extending strengthening band of material around the lower portion of the container, as illustrated in FIGS. 6B–6D. The left most end of the folded panels 39 and 40 (as configured in FIG. 6A) defines a receptor pocket for receiving the tab 40*a* of panel 40. The pattern is then folded along the corner fold lines 32*a*–32*d* to define a box-like internal cavity as illustrated in FIG. 6B such that side edges 34*a* and 34*b* move toward one another, and until the side edge 34*a* engages the slot S4 and the side edge 34*b*. At this position, the tab 40*a* will be slideably received by the pocket formed between panel members 39 and 40, the lower connecting tab 33*b* will slide behind the sidewall 31*d*, and the upper arcuate tab 33*a* will be slideably received by the slot S4. Further movement of the panels will form the configuration illustrated in FIG. 6C. At this stage, the forming member 30 is still foldable on itself, and can be folded into a collapsed position, since the bottom 45 has not yet been formed.

The bottom 45 of the forming member 30 is defined by folding in the lower panel extensions 41 toward the center of the enclosed cavity defined by the connected sidewalls 31. As illustrated in FIGS. 6C and 6D, the lower panels 41*b* and 41*d* are folded in first, followed by lower panels 41*a* and 41*c*. Such bottom configuration 45 defines and locks in the positions of the sidewalls and collectively defines an internal geometric solid shaped cavity having an initial rectangular or square cross-sectional shape. As described above, as bulk material is added to the internal cavity of the forming member, the resultant pressure applied by the bulk material to the sidewalls of the forming member will cause the sidewalls to deform along the score lines 50 adjacent the corners 32 to provide stress relief to the container assembly, while retaining the underlying stability of the container assembly that is provided by the forming member.

While several configurations of forming member have been described with respect to specific preferred embodiments of the invention, those skilled in the art will readily recognize that many other configurations of such forming members can be designed within the scope of this invention. Further, while specific corrugated materials have been described for use in association with constructing the forming members, those skilled in the art will readily recognize that other materials can be employed.

Figure 7:
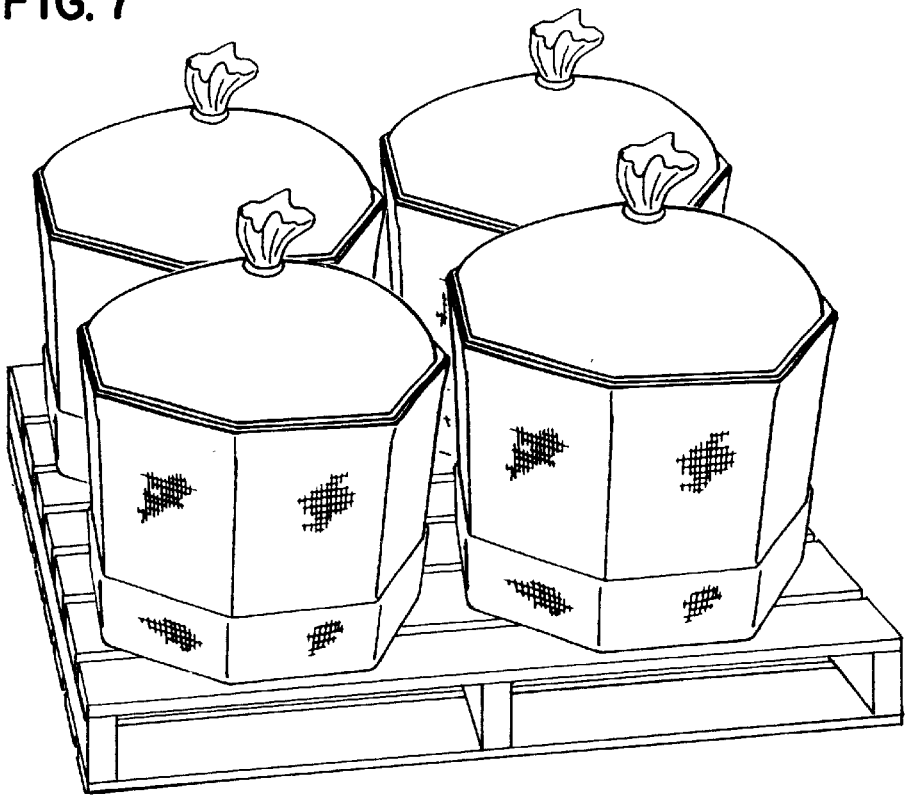
FIG. 7 is a diagrammatic perspective view illustrating a plurality of the bulk material containers of the present invention cooperatively positioned on a pallet.

FIG. 7 illustrates the fact that the container apparatus of the present invention can be employed in situations wherein multiple such container assemblies are supported by a single pallet. While the container assemblies of FIG. 7 have been illustrated as being separated from one another, they could equally well have been positioned so as to engage one another for forming a more stabilized pallet block of such container assemblies.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A container for bulk materials, comprising:

(a) an inner forming member comprising:

(i) at least one sheet of corrugated material folded to define a plurality of contiguous sidewall segments extending between lower and upper edges with at least two of said sidewall segments slidably engaging one another along their respective lengths between said lower and upper edges, said lower edges being configured to be supported by a planar surface;

(ii) said sidewall segments encircling and defining an expandable internal volume therebetween with a cross-sectional shape and area as defined by planes parallel to the upper or lower sidewall edges;

(b) positioning means cooperatively engaging at least some of said sidewall segments for expandably slidably holding said sidewall segments in general positional relationships relative to one another while permitting limited movement of said sidewalls relative to one another that changes said cross-sectional area and shape of said internal volume; and (c) an outer continuous flexible sleeve member of woven material sized to snuggly slidably engage substantially the entire outer surfaces of said sidewall segments between said lower and tupper sidewall edges, and having no top or bottom portions extending across the cross-section of said internal cavity; said sleeve being operable to retain the general relative positioning of said sidewall segments as bulk materials are loaded into said internal cavity and being of a strength operable to contain radial forces applied by bulk materials through said sidewalls, while permitting limited relative movement of said sidewalls in a radial direction that changes the shape and expands said cross-sectional area of said internal volume.

2. The container as recited in claim 1, wherein said inner forming member comprises a single piece of corrugated material.

3. The container as recited in claim 1, wherein said forming member is collapsible when said positioning means is not operably engaging said sidewalls.

4. The container as recited in claim 1, wherein said inner forming member engages said sidewall segments along their said lower edges.

5. The container as recited in claim 4, wherein said positioning means forms a bottom of inner forming member and extends at least partially across the cross-sectional area of said internal cavity.

6. The container as recited in claim 1, wherein the outer sleeve member comprises continuous seamless woven material.

7. The container as recited in claim 1, wherein said sleeve is tubular in shape and of substantially the same cross-sectional dimension along its entire length.

8. The container as recited in claim 7, wherein said sleeve comprises polypropylene or polyethylene material.

9. The container as recited in claim 1, wherein said corrugated material comprises cellulose material.

10. The container as recited in claim 1, wherein said corrugated material comprises plastic material.

11. The container as recited in claim 1, wherein said sleeve is configured with a fold extending upward from the lower edges of the sidewall segments to provide double strength resistance to forces directed outwardly from the internal cavity adjacent the lower edges of said sidewalls.

12. The container as recited in claim 11, wherein said fold extends upward from said lower edges from about 20%–50% of the distance between said lower and said upper edges of said sidewalls.

13. The container as recited in claim 1, wherein at least one of said sidewall segments includes a stress relief portion allowing for slight deformation of said sidewall along predetermined positions along said upper edge thereof.

14. The container as recited in claim 1, further including a liner of impervious material, sized and configured for placement within said internal cavity of the inner forming member.

15. The container as recited in claim 1, wherein said planar surface comprises an upper surface of a pallet.

16. A kit for a bulk material container, comprising:

(a) an inner forming member comprising:

(i) at least one sheet of corrugated material foldable to define a plurality of contiguous sidewall segments extending between lower and upper edges such that at least two of said sidewall segments slidably engage one another along their respective lengths between said lower and upper edges, said lower edges being configured to be supported by a planar surface;

(ii) said sidewall segments being foldable to encircle and define an expandable internal volume therebetween with a cross-sectional shape and area as defined by planes parallel to the upper or lower sidewall edges;

(b) positioning means configured to cooperatively engage at least some of said sidewall segments for expandably slidably holding said sidewall segments in general positional relationships relative to one another while permitting limited movement of said sidewalls relative to one another that changes said cross-sectional area and shape of said internal volume; and (c) an outer continuous flexible sleeve member of continuous woven material sized to snuggly slidably engage substantially the entire outer surfaces of said sidewall segments between said lower and upper sidewall edges, such that no top or bottom portions of the sleeve extend across the cross-section of said internal cavity; said sleeve being operable to retain the general relative positioning of said sidewall segments as bulk materials are loaded into said internal cavity and being of a strength operable to contain radial forces applied by bulk materials through said sidewalls, while permitting limited relative movement of said sidewalls in a radial direction that changes the shape and expands said cross-sectional area of said internal volume.

* * * * *